US011428101B2

(12) United States Patent
Qi et al.

(10) Patent No.: US 11,428,101 B2
(45) Date of Patent: Aug. 30, 2022

(54) ANTI-SEISMIC SUPPORT METHOD FOR MINE SHAFT

(71) Applicant: CHINA COAL RESEARCH INSTITUTE, Beijing (CN)

(72) Inventors: Qingjie Qi, Beijing (CN); Anhu Wang, Beijing (CN); Wengang Liu, Beijing (CN); Haiyan Wang, Beijing (CN); Yingjie Liu, Beijing (CN); Youxin Zhao, Beijing (CN); Shuai Huang, Beijing (CN)

(73) Assignee: CHINA COAL RESEARCH INSTITUTE, Beijing (CN)

( * ) Notice: Subject to any disclaimer, the term of this patent is extended or adjusted under 35 U.S.C. 154(b) by 0 days.

(21) Appl. No.: 17/356,918

(22) Filed: Jun. 24, 2021

(65) Prior Publication Data

US 2022/0018250 A1 Jan. 20, 2022

(30) Foreign Application Priority Data

Jul. 16, 2020 (CN) ..... 202010688576.7

(51) Int. Cl.

| | |
|---|---|
| ***E21D 5/10*** | (2006.01) |
| ***E21D 5/11*** | (2006.01) |
| ***E21D 5/12*** | (2006.01) |
| ***E21D 20/02*** | (2006.01) |

(52) U.S. Cl.

CPC ..... *E21D 5/10* (2013.01); *E21D 5/11* (2013.01); *E21D 5/12* (2013.01); *E21D 20/02* (2013.01)

(58) Field of Classification Search

CPC .... E21D 5/10; E21D 5/11; E21D 5/12; E21D 9/14; E21F 11/00

USPC ..... 299/11, 12; 405/133

See application file for complete search history.

(56) References Cited

U.S. PATENT DOCUMENTS

2012/0132424 A1* 5/2012 Watson ..... E21D 1/00 175/62

FOREIGN PATENT DOCUMENTS

| | | | | |
|---|---|---|---|---|
| CA | 2714763 A1 * | 3/2012 | ..... | E21B 43/10 |
| CN | 110030017 A * | 7/2019 | ..... | E21D 11/105 |
| CN | 110159314 A * | 8/2019 | | |
| CN | 111997618 A * | 11/2020 | ..... | E21B 43/10 |
| RU | 2743724 C1 * | 2/2021 | ..... | E21D 11/105 |
| WO | WO-2021026971 A1 * | 2/2021 | ..... | E21D 5/11 |

* cited by examiner

*Primary Examiner* — Frederick L Lagman

(74) *Attorney, Agent, or Firm* — Hodgson Russ LLP

(57) ABSTRACT

An anti-seismic support method for a mine shaft includes: providing a circular support groove in a liquefaction-prone layer of the mine shaft; providing horizontal support holes in a groove wall, and fixing an outer support spring steel cylinder against the groove wall; drilling vertical support holes at a groove bottom, anchoring a vertical anchor rod group into the vertical support holes, and injecting an expansion anchoring slurry into the vertical anchor rod group; making a lower positioning support ring abut against an upper end of the vertical anchor rod group and an inner wall of the outer support spring steel cylinder; fixing an anti-seismic connecting rod group between lower and upper positioning support rings; making an outer wall of an inner support spring steel cylinder abut against the upper and lower positioning support rings; and providing an upper support cover seat atop the outer and inner support spring steel cylinders.

14 Claims, 3 Drawing Sheets

ANTI-SEISMIC SUPPORT METHOD FOR MINE SHAFT

CROSS-REFERENCE TO RELATED APPLICATIONS

This application claims priority to and benefits of Chinese Patent Application No. 202010688576.7, filed on Jul. 16, 2020, the entire contents of which is incorporated by reference herein.

FIELD

This application relates to the field of shaft support technology, and more particularly to an anti-seismic support method for a mine shaft.

BACKGROUND

Mine shafts belong to one of the most important mine laneway projects in underground mines and serve as an essential route for mineral resources, materials, equipment, personnel, wind and electricity, which is a key link of the entire mine production system. It is vital to ensure the structural integrity and unobstructedness of the mine shaft after an earthquake disaster, which is crucial to the normal operation of the entire mine and the safety of underground workers. There are two main types of earthquake damage to mine shafts: (1) direct damage to shaft equipment caused by earthquake propagation; (2) indirect damage to a shaft wall due to earthquake damage to soil at the site. The second type of damage is more common and is related to liquefaction and flow-slip movement of a shallow sand layer of the shaft at the site under the action of earthquakes. When an earthquake occurs, the soil layer, sand layer and other liquefaction-prone layers suffer from lateral stress much more severely than bedrock layers, and the liquefaction-prone layers are more likely to be damaged than the bedrock layers.

In the related art, reinforced concrete structures are generally adopted in an entire wall of a vertical shaft to reduce damage caused by earthquakes.

However, this method does not fully consider differences of soil layers, sand layers, bedrock layers and other geotechnical soils. When the overall support strength of the shaft wall is low, the liquefaction-prone layers are easily damaged by earthquakes; when the overall support strength of the shaft wall is high, it is easy to cause excessive use and waste of support materials. These problems need to be solved.

SUMMARY

Embodiments of the present disclosure propose an anti-seismic support method for a mine shaft. The method includes the following steps: providing a circular support groove in a liquefaction-prone layer of the mine shaft; providing a plurality of horizontal support holes along a radial direction in a groove wall of the circular support groove, fixing an outer support spring steel cylinder against the groove wall, and providing a horizontal transverse anchor rod group to fix the outer support spring steel cylinder; drilling vertical support holes at a groove bottom of the circular support groove, anchoring a vertical anchor rod group into the vertical support holes, and injecting an expansion anchoring slurry into the vertical anchor rod group to expand an expansion open end; making a lower positioning support ring abut against and be supported on an upper end of the vertical anchor rod group, and making the lower positioning support ring abut against an inner wall of the outer support spring steel cylinder; connecting and fixing an anti-seismic connecting rod group between the lower positioning support ring and an upper positioning support ring; welding an inner support spring steel cylinder to an end of the horizontal transverse anchor rod group fixedly, and making an outer wall of the inner support spring steel cylinder abut against the upper positioning support ring and the lower positioning support ring; providing an upper support cover seat at a top of the outer support spring steel cylinder and the inner support spring steel cylinder, and providing an anchoring layer on a wall of the mine shaft located below the inner support spring steel cylinder.

Additional aspects and advantages of embodiments of the present disclosure will be given in part in the following descriptions, become apparent in part from the following descriptions, or be learned from the practice of the embodiments of the present disclosure.

DETAILED DESCRIPTION

Figure 1:
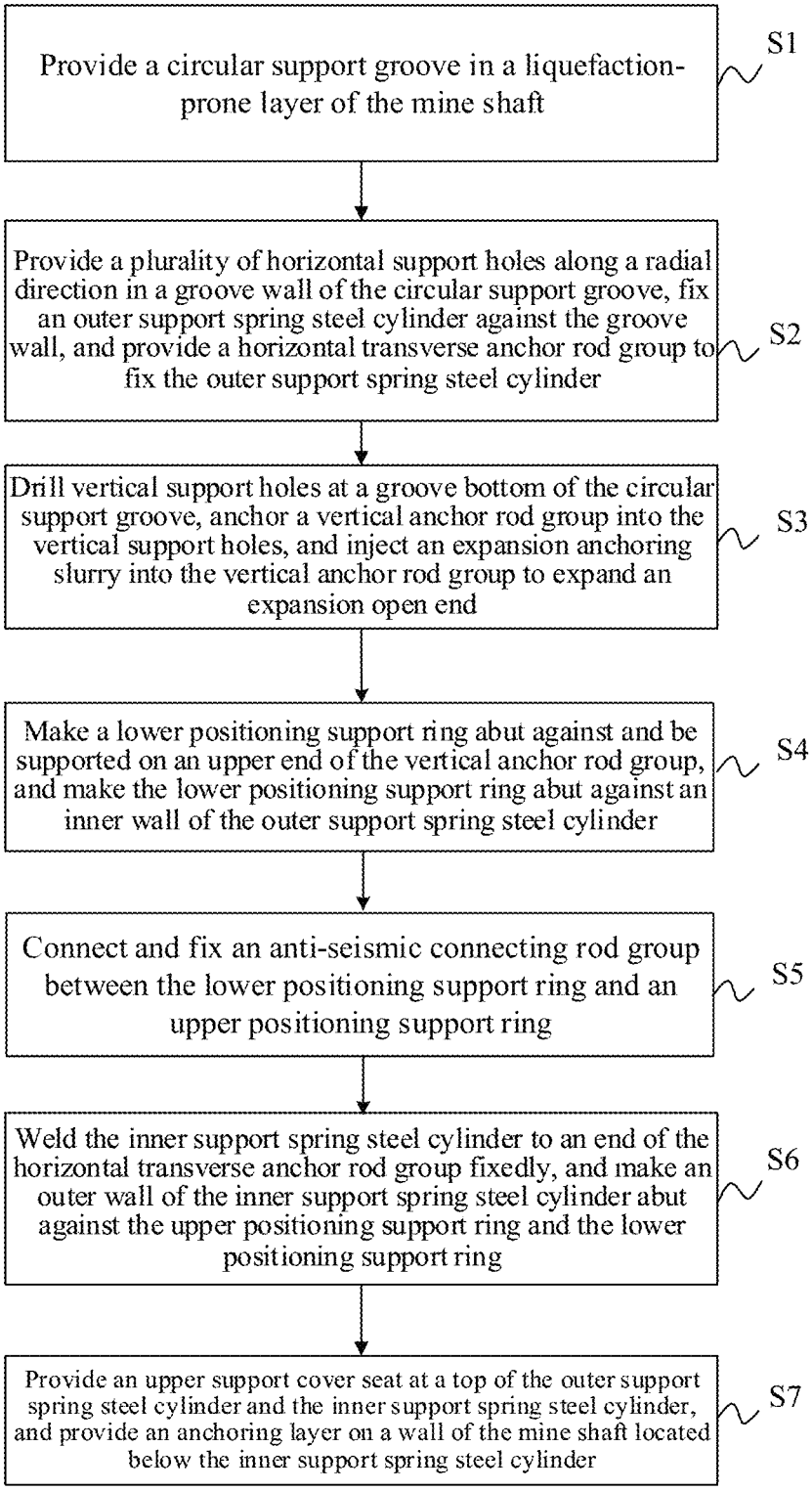
FIG. 1 is a schematic block diagram of an anti-seismic support method for a mine shaft according to an embodiment of the present disclosure.

Embodiments of the present disclosure will be described in detail below, and examples of the embodiments will be shown in the accompanying drawings. The same or similar elements and the elements having same or similar functions are denoted by like reference numerals throughout the descriptions. The embodiments described below are exemplary and are intended to explain the present disclosure rather than limit the present disclosure.

An anti-seismic support method for a mine shaft according to embodiments of the present disclosure will be described below with reference to the accompanying drawings.

FIG. 1 is a flowchart of an anti-seismic support method for a mine shaft according to an embodiment of the present disclosure. As shown in FIG. 1, the anti-seismic support method includes the following steps.

S1: a circular support groove 100 is provided in a liquefaction-prone layer of the mine shaft.

It can be understood that if the circular support groove 100 is arranged in the liquefaction-prone layer of the mine shaft, a size of the circular support groove 100 is related to a layer thickness of the liquefaction-prone layer, and is generally not greater than 4 m, which can be specifically determined by those skilled in the art according to actual situations and will not be particularly defined here.

S2: a plurality of horizontal support holes 101 are provided along a radial direction in a groove wall of the circular support groove 100, an outer support spring steel cylinder is fixed against the groove wall, and a horizontal transverse anchor rod group is provided to fix the outer support spring steel cylinder.

According to an embodiment of the present disclosure, each anchor rod in the horizontal transverse anchor rod group and in a vertical anchor rod group is a hollow anchor rod.

According to an embodiment of the present disclosure, a plurality of upper horizontal transverse anchor rods are arranged in a circumferential array along a central axis of the shaft, and a plurality of lower horizontal transverse anchor rods are also arranged in a circumferential array along the central axis of the shaft.

S3: vertical support holes 102 are drilled at a groove bottom of the circular support groove 100, the vertical anchor rod group is anchored into the vertical support holes 102, and an expansion anchoring slurry is injected into the vertical anchor rod group to expand an expansion open end.

S4: a lower positioning support ring abuts against and is supported on an upper end of the vertical anchor rod group, and the lower positioning support ring abuts against an inner wall of the outer support spring steel cylinder.

According to an embodiment of the present disclosure, an anchoring depth of a vertical anchor rod near the outer support spring steel cylinder is greater than an anchoring depth of a vertical anchor rod near an inner support spring steel cylinder.

S5: an anti-seismic connecting rod group is connected and fixed between the lower positioning support ring and an upper positioning support ring.

According to an embodiment of the present disclosure, the anti-seismic connecting rod group includes a plurality of anti-seismic connecting rods arranged at intervals in an array. Obtaining the anti-seismic connecting rods includes: making an upper cylindrical fixing and clamping section fixedly clamped and pass through the upper positioning support ring; connecting the upper cylindrical fixing and clamping section with an elastic deformation and torsion-resistant section by an upper torsion-resistant connecting post; connecting a lower cylindrical fixing and clamping section with the elastic deformation and torsion-resistant section by a lower torsion-resistant connecting post; and making the lower cylindrical fixing and clamping section fixedly clamped and pass through the lower positioning support ring.

S6: the inner support spring steel cylinder is fixedly welded to an end of the horizontal transverse anchor rod group, and an outer wall of the inner support spring steel cylinder abuts against the upper positioning support ring and the lower positioning support ring.

According to an embodiment of the present disclosure, a radial thickness of the inner support spring steel cylinder is greater than a radial thickness of the outer support spring steel cylinder.

S7: an upper support cover seat is provided at the top of the outer support spring steel cylinder and the inner support spring steel cylinder, and an anchoring layer 200 is provided on a wall of the shaft located below the inner support spring steel cylinder.

According to an embodiment of the present disclosure, the anchoring layer 200 consists of an anchoring sheet net 201 and an anchoring slurry.

In order to enable those skilled in the art to further understand the anti-seismic support method according to the embodiments of the present disclosure, an anti-seismic support structure involved in the anti-seismic support method according to the embodiments of the present disclosure will be described in detail below.

Figure 2:
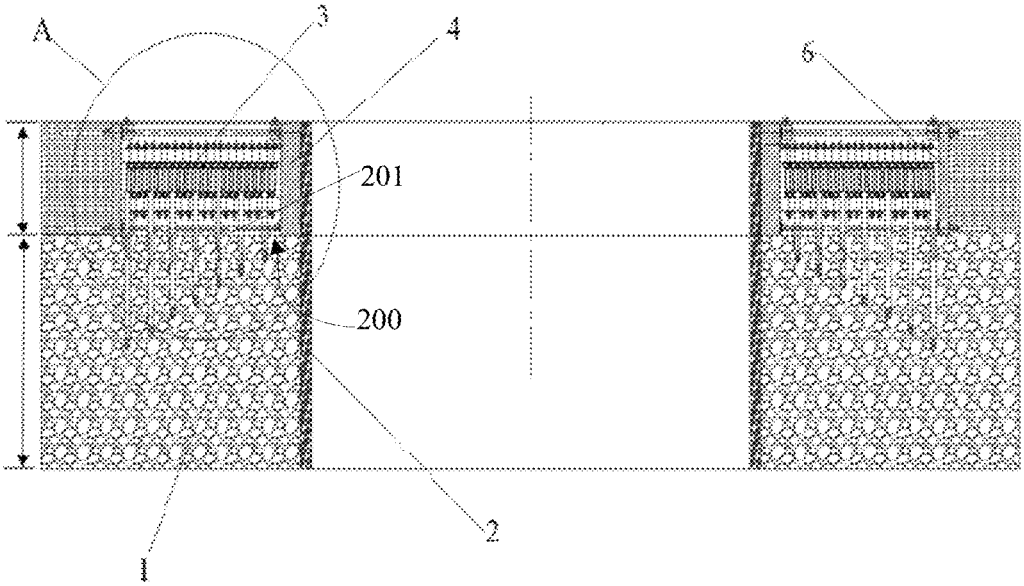
FIG. 2 is a schematic structural diagram of an anti-seismic support method for a mine shaft according to an embodiment of the present disclosure.
Figure 3:
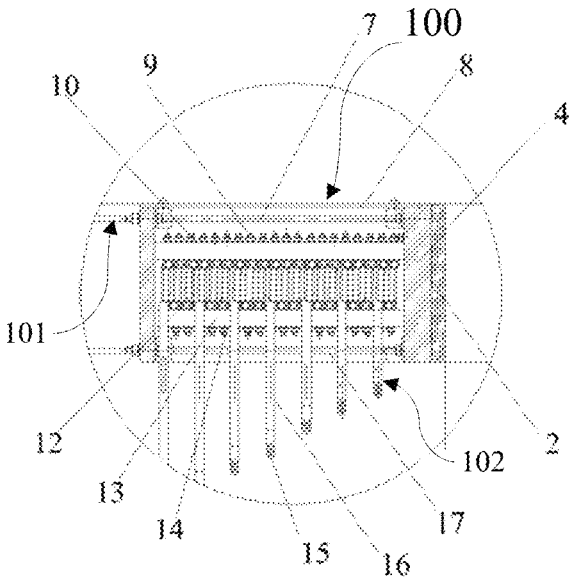
FIG. 3 is an enlarged view of part A circled in FIG. 2.
Figure 4:
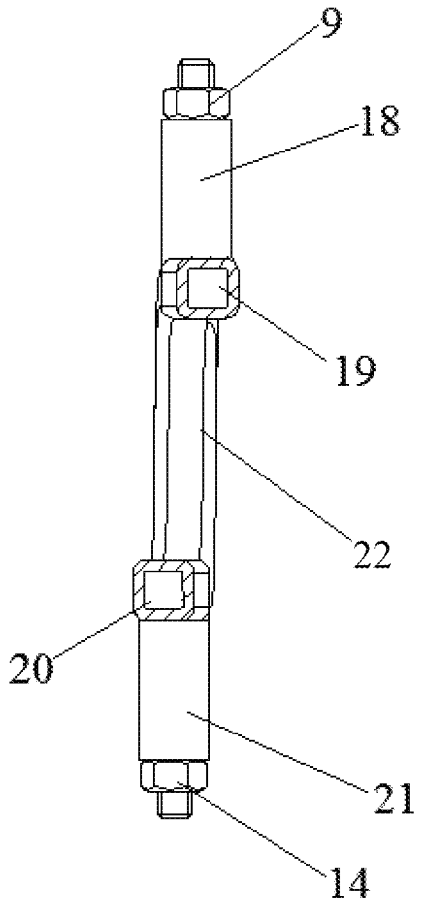
FIG. 4 is a schematic structural diagram of an anti-seismic connecting rod according to an embodiment of the present disclosure.

As shown in FIG. 2, the anti-seismic support structure includes a shaft wall support structure 2, an outer support spring steel cylinder 6, an inner support spring steel cylinder 4, and an anti-seismic support connection mechanism 3. The shaft wall support structure 2 is arranged on a shaft wall of the mine shaft. The outer support spring steel cylinder 6 and the inner support spring steel cylinder 4 are both cylindrical structures. An upper support cover seat 8 is provided at a top of the outer support spring steel cylinder 6 and the inner support spring steel cylinder 4. The outer support spring steel cylinder 6 and the inner support spring steel cylinder 4 are supported on and connected to a rock layer 1 at an upper end of the mine shaft by using the anti-seismic support connection mechanism 3, in which the rock layer 1 is not easily liquefied. The anti-seismic support connection mechanism 3 includes a horizontal transverse anchor rod group, a vertical anchor rod group, an upper positioning support ring 10, a lower positioning support ring 13, and an anti-seismic connecting rod group 12. A plurality of horizontal transverse anchor rod groups are arranged on an outer wall of the inner support spring steel cylinder 4 and extend along a horizontal radial direction of the inner support spring steel cylinder 4. The horizontal transverse anchor rod groups extend into a rock layer at the shaft after passing through the outer support spring steel cylinder 6. The horizontal transverse anchor rod groups include a plurality of upper horizontal transverse anchor rods 7 and a plurality of lower horizontal transverse anchor rods 17. The vertical anchor rod group includes a plurality of vertical anchor rods 16, each having an expansion open end 15. The upper positioning support ring 10 and the lower positioning support ring 13 are provided in an area enclosed between the outer support spring steel cylinder 6 and the inner support spring steel cylinder 4. The upper positioning support ring 10 and the lower positioning support ring 13 are connected together in an up-down direction by the anti-seismic connecting rod group 12, and the lower positioning support ring 13 is anchored in the rock layer at the shaft by the vertical anchor rod group extending downward. The anti-seismic connecting rod group 12 is connected to the upper positioning support ring 10 by upper bolts 9 and to the lower positioning support ring 13 by lower bolts 14 and is made of spring steel with elastic deformability. The anti-seismic connecting rod group 12 includes a plurality of anti-seismic connecting rods arranged at intervals in an array, as illustrated in FIG. 4 that is a schematic structural diagram of the anti-seismic connecting rod. The anti-seismic connecting rod includes an upper cylindrical fixing and clamping section 18, a lower cylindrical fixing and clamping section 21, an elastic deformation and torsion-resistant section 22, an upper torsion-resistant connecting post 19, a lower torsion-resistant connecting post 20. As a result, the lateral stress and rheological deformation of the liquefaction-prone layer can be effectively resisted after the occurrence of earthquakes, which effectively ensures the deformation resistance and torsion resistance of the entire support structure, improves the anti-seismic effect, and guarantees a support effect on the mine shaft area.

With the anti-seismic support method for the mine shaft proposed in the embodiments of the present disclosure, the anti-seismic support connection mechanism is configured as an integral structure, so that it has a certain elastic deformation ability, and can effectively resist the lateral stress and rheological deformation of the liquefaction-prone layer after earthquakes, effectively guarantee the deformation resistance and torsion resistance of the entire support structure, effectively ensure the anti-seismic performance, and improve the anti-seismic effect, to ensure the support effect on the mine shaft area and better realize the support to the mine shaft area.

In the description of the present disclosure, it is to be understood that terms such as "central," "longitudinal," "transverse," "length," "width," "thickness," "upper," "lower," "front," "rear," "left," "right," "vertical," "horizontal," "top," "bottom," "inner," "outer," "clockwise," "counterclockwise," "axial," "radial" and "circumferential" should be construed to refer to the orientation as then described or as shown in the drawings under discussion. These relative terms are for convenience and simplicity of description and do not indicate or imply that the devices or elements referred to have a particular orientation and be constructed or operated in a particular orientation. Thus, these terms shall not be construed as limitation on the present disclosure.

In addition, terms such as "first" and "second" are used herein for purposes of description and are not intended to indicate or imply relative importance or significance or to imply the number of indicated technical features. Thus, the feature defined with "first" and "second" may comprise one or more of this feature. In the description of the present disclosure, the term "a plurality of" means two or more than two, unless specified otherwise.

In the present disclosure, unless specified or limited otherwise, the terms "mounted," "connected," "coupled," "fixed" and the like are used broadly, and may be, for example, fixed connections, detachable connections, or integral connections; may also be mechanical or electrical connections; may also be direct connections or indirect connections via intervening structures; may also be inner communication or interaction of two elements, which can be understood by those skilled in the art according to specific situations.

In the present disclosure, unless specified or limited otherwise, a structure in which a first feature is "on" or "below" a second feature may include an embodiment in which the first feature is in direct contact with the second feature, and may also include an embodiment in which the first feature and the second feature are not in direct contact with each other, but are contacted via an additional feature formed therebetween. Furthermore, a first feature "on," "above," or "on top of" a second feature may include an embodiment in which the first feature is right or obliquely "on," "above," or "on top of" the second feature, or just means that the first feature is at a height higher than that of the second feature; while a first feature "below," "under," or "on bottom of" a second feature may include an embodiment in which the first feature is right or obliquely "below," "under," or "on bottom of" the second feature, or just means that the first feature is at a height lower than that of the second feature.

Reference throughout this specification to "an embodiment," "some embodiments," "an example," "a specific example," or "some examples," means that a particular feature, structure, material, or characteristic described in connection with the embodiment or example is included in at least one embodiment or example of the present disclosure. Thus, the above terms throughout this specification are not necessarily referring to the same embodiment or example of the present disclosure. Furthermore, the particular features, structures, materials, or characteristics may be combined in any suitable manner in one or more embodiments or examples. Moreover, those skilled in the art can integrate and combine the different embodiments or examples and the features of the different embodiments or examples described in this specification without contradicting each other.

Although embodiments of the present disclosure have been shown and described, it can be appreciated by those skilled in the art that the above embodiments are merely exemplary and are not intended to limit the present disclosure, and various changes, modifications, alternatives and variations may be made in the embodiments within the scope of the present disclosure.

What is claimed is:

1. An anti-seismic support method for a mine shaft, comprising:

providing a circular support groove in a liquefaction-prone layer of the mine shaft;

providing a plurality of horizontal support holes along a radial direction in a groove wall of the circular support groove, fixing an outer support spring steel cylinder against the groove wall, and providing a horizontal transverse anchor rod group to fix the outer support spring steel cylinder;

drilling vertical support holes at a groove bottom of the circular support groove, anchoring a vertical anchor rod group into the vertical support holes, and injecting an expansion anchoring slurry into the vertical anchor rod group to expand an expansion open end;

making a lower positioning support ring abut against and be supported on an upper end of the vertical anchor rod group, and making the lower positioning support ring abut against an inner wall of the outer support spring steel cylinder;

connecting and fixing an anti-seismic connecting rod group between the lower positioning support ring and an upper positioning support ring;

welding an inner support spring steel cylinder to an end of the horizontal transverse anchor rod group fixedly, and making an outer wall of the inner support spring steel cylinder abut against the upper positioning support ring and the lower positioning support ring; and providing an upper support cover seat at a top of the outer support spring steel cylinder and the inner support spring steel cylinder, and providing an anchoring layer on a wall of the mine shaft located below the inner support spring steel cylinder.

2. The anti-seismic support method according to claim 1, wherein a radial thickness of the inner support spring steel cylinder is greater than a radial thickness of the outer support spring steel cylinder.

3. The anti-seismic support method according to claim 1, wherein each anchor rod in the horizontal transverse anchor rod group and in the vertical anchor rod group is a hollow anchor rod.

4. The anti-seismic support method according to claim 1, wherein a plurality of upper horizontal transverse anchor rods are arranged in a circumferential array along a central axis of the mine shaft, and a plurality of lower horizontal transverse anchor rods are arranged in a circumferential array along the central axis of the mine shaft.

5. The anti-seismic support method according to claim 1, wherein an anchoring depth of a vertical anchor rod near the outer support spring steel cylinder is greater than an anchoring depth of a vertical anchor rod near the inner support spring steel cylinder.

6. The anti-seismic support method according to claim 1, wherein the anchoring layer comprises an anchoring sheet net and an anchoring slurry.

7. The anti-seismic support method according to claim 1, wherein obtaining the anti-seismic connecting rods comprises:

making an upper cylindrical fixing and clamping section fixedly clamped and pass through the upper positioning support ring;

connecting the upper cylindrical fixing and clamping section with an elastic deformation and torsion-resistant section by an upper torsion-resistant connecting post;

connecting a lower cylindrical fixing and clamping section with the elastic deformation and torsion-resistant section by a lower torsion-resistant connecting post; and making the lower cylindrical fixing and clamping section fixedly clamped and pass through the lower positioning support ring.

8. The anti-seismic support method according to claim 1, wherein the outer support spring steel cylinder and the inner support spring steel cylinder are supported on and connected to a rock layer at an upper end of the mine shaft by an anti-seismic support connection mechanism.

9. The anti-seismic support method according to claim 8, wherein the anti-seismic support connection mechanism comprises the horizontal transverse anchor rod group, the vertical anchor rod group, the upper positioning support ring, the lower positioning support ring, and the anti-seismic connecting rod group.

10. The anti-seismic support method according to claim 8, wherein the lower positioning support ring is anchored in the rock layer by the vertical anchor rod group extending downward.

11. The anti-seismic support method according to claim 1, wherein a plurality of horizontal transverse anchor rod groups are arranged on the outer wall of the inner support spring steel cylinder and extend along a horizontal radial direction of the inner support spring steel cylinder.

12. The anti-seismic support method according to claim 1, wherein the upper positioning support ring and the lower positioning support ring are arranged in an area enclosed between the outer support spring steel cylinder and the inner support spring steel cylinder.

13. The anti-seismic support method according to claim 1, wherein the upper positioning support ring and the lower positioning support ring are connected together in an up-down direction by the anti-seismic connecting rod group.

14. The anti-seismic support method according to claim 1, wherein the anti-seismic connecting rod group comprises a plurality of anti-seismic connecting rods arranged at intervals in an array.

* * * * *